US005380375A

United States Patent [19]

Hashimoto et al.

[11] Patent Number: 5,380,375

[45] Date of Patent: Jan. 10, 1995

[54] AMORPHOUS ALLOYS RESISTANT AGAINST HOT CORROSION

[75] Inventors: Koji Hashimoto, 2-25-2, Shogen, Izumi-ku, Sendai-shi. Miyagi; Hiroki Habazaki, Sendai, both of Japan; Stanislaw Mrowec; Marek Danielewski, both of Cracow, Poland

[73] Assignees: Koji Hashimoto, Miyagi; Yoshida Kogyo K.K., Tokyo, both of Japan

[21] Appl. No.: 158,013

[22] Filed: Nov. 24, 1993

Related U.S. Application Data

[62] Division of Ser. No. 44,534, Apr. 7, 1993.

[30] Foreign Application Priority Data

Apr. 7, 1992 [JP] Japan ..... 4-85529
Apr. 7, 1992 [JP] Japan ..... 4-85530
Nov. 11, 1992 [JP] Japan ..... 4-326075

[51] Int. Cl.[6] ..... C22C 45/00; C22C 45/10

[52] U.S. Cl. ..... 148/403; 420/425; 420/426; 420/427; 420/428

[58] Field of Search ..... 420/421–428; 148/403

[56] References Cited

U.S. PATENT DOCUMENTS

Re. 33,022 8/1989 Takayama et al. ..... 148/403
4,885,128 12/1989 Megusar et al. ..... 420/422

FOREIGN PATENT DOCUMENTS 5-105996 4/1993 Japan .

*Primary Examiner*—George Wyszomierski
*Attorney, Agent, or Firm*—Flynn, Thiel, Boutell & Tanis

[57] ABSTRACT

An amorphous alloy which is resistant to hot corrosion in sulfidizing and oxidizing atmospheres at high temperatures, consisting of Cr and at least one element selected from refractory metals of Nb and Ta, a portion of the set forth refractory metals being allowed to be substituted with at least one element selected from Ti, Zr, Fe, Co, Ni and Cu. The addition of Si further improves the alloy's oxidation resistance.

4 Claims, 1 Drawing Sheet

AMORPHOUS ALLOYS RESISTANT AGAINST HOT CORROSION

This is a division of Ser. No. 08/044,534, filed Apr. 7, 1993.

BACKGROUND OF THE INVENTION

1. Field of the Invention

The present invention relates to novel amorphous alloys resistant against hot corrosion in sulfidizing and oxidizing atmospheres, which can be used in industrial plants such as chemical plants as well as various fields of human life.

2. Description of the Prior Art

Some of the present inventors have so far found various amorphous alloys having high corrosion resistance in hot concentrated acids. These alloys are classified into two groups, that is, amorphous metal-metalloid alloys and metal-metal alloys. Amorphous metal-metalloid alloys are composed of iron group elements such as Fe, Co and Ni and 10–25 atomic percent of metalloid elements such as P, C, Si and B. Their high corrosion resistance in aqueous solutions is obtained by the addition of chromium. By contrast, amorphous metal-metal alloys are formed by alloying of Fe, Co, Ni, Cu and/or Al with IVa and Va group elements such as Ta, Nb, Zr and Ti. Their corrosion resistance in aqueous solutions is due to the presence of valve metals.

Some of the present inventors and coinventors in preparing a number of novel amorphous alloys found that alloys in which the melting point of one of the alloy constituents far exceeds the boiling point of another alloy constituent can be prepared by utilizing a sputter-deposition method, since sputtering does not require melting for alloy formation. Some of the present inventors and coinventors thus succeeded in preparing amorphous Cu- and Al-based alloys with IVa, Va and VIa group elements such as Ti, Zr, Nb, Ta, Mo and W, and applied for Japanese Patent Application Nos. 103296/87, 515567/88, 51568/88 and 260020/88 for these alloys. Some of the present inventors and coinventors further continued to study the preparation of various amorphous alloys and succeeded in preparing amorphous Cr-base alloys with Ti, Zr, Nb, Ta and Al. They applied for Japanese Patent Application Nos. 138575/91, 267542/91, 29362/92 and 29365/92 for these alloys.

Aluminum forms the most stable and protective oxide scale in oxidizing atmospheres at high temperatures, and chromium is the second best element for oxidation resistance among conventional elements. Accordingly, alloys containing these elements have been used in highly oxidizing gas atmospheres at high temperatures. However, aluminum and chromium sulfides are not highly protective, and aluminum sulfide decomposes when it is exposed to a humid atmosphere.

On the other hand, elements which can form stable sulfide scales in highly sulfidizing atmospheres at high temperatures are Mo, W, Nb and Ta. However, when these elements are exposed to oxidizing atmospheres, sublimation of oxides for Mo and W, and breakaway of oxides for Nb and Ta readily occur.

In practical hot corrosion atmospheres, the partial pressures of sulfur vapor and oxygen change drastically. Nevertheless, there were no metallic materials which have sufficiently high resistance against hot corrosion in both sulfidizing and oxidizing atmospheres at high temperatures.

Consequently, there has been a strong demand for further new metallic materials having a high resistance against hot corrosion and which can be used in both sulfidizing and oxidizing atmospheres at high temperatures.

SUMMARY OF THE INVENTION

It is an objective of the present invention to provide amorphous alloys resistant to hot corrosion in both sulfidizing and oxidizing atmospheres at high temperatures by utilizing the characteristic of amorphous alloys forming a single phase solid solution containing alloying elements which exceed their the solubility limits at equilibrium and by utilizing the advantage of sputtering, which does not require melting, for the formation of the alloy.

The objective of the invention is achieved by forming amorphous Al and/or Cr alloys with Ta, Nb, Mo and/or W as essential components.

According to the present invention, the following alloys are provided:

(1) An amorphous alloy which is resistant to hot corrosion, which consists of 7–50 atomic percent of at least one element selected from the group of Mo and W, with the balance being substantially Al.

(2) An amorphous alloy which is resistant to hot corrosion, which consists of 7–75 atomic percent of at least one element selected from the group of Ta and Nb, with the balance being substantially Al.

(3) An amorphous alloy which is resistant to hot corrosion, which consists of 7–75 atomic percent of the sum of at least one element selected from the group of Ta and Nb and, at most 50 atomic percent of at least one element selected from the group of Mo and W, with the balance being substantially Al.

(4) An amorphous alloy which is resistant to hot corrosion, which consists of, at most, 75 atomic percent of the sum of at least one element selected from the group of Ti and Zr and 7–50 atomic percent of at least one element selected from the group of Mo and W, with the balance being substantially Al.

(5) An amorphous alloy which is resistant to hot corrosion, which consists of, at most, 75 atomic percent of the sum of at least one element selected from the group of Ti and Zr and at least 7 atomic percent of at least one element selected from the group of Ta and Nb, with the balance being substantially Al.

(6) An amorphous alloy which is resistant to hot corrosion, which consists of, at most, 75 atomic percent of the sum of at least one element selected from the group of Ti and Zr and at least 7 atomic percent of the sum of at least one element selected from the group of Ta and Nb and, at most, 50 atomic percent of at least one element selected from the group of Mo and W, with the balance being substantially Al.

(7) An amorphous alloy which is resistant to hot corrosion, which consists of, at most, 20 atomic percent of at least one element selected from the group of Fe, Co, Ni and Cu and at least 7 atomic percent and less than 50 atomic percent of at least one element selected from the group of Mo and W, with the balance being substantially Al.

(8) An amorphous alloy which is resistant to hot corrosion, which consists of, at most, 20 atomic percent of at least one element selected from the group of Fe, Co, Ni and Cu and at least 7 atomic percent and less than 75 atomic percent of at least one element selected from the group of Ta and Nb, with the balance being substantially at least 25 atomic percent of Al.

(9) An amorphous alloy which is resistant to hot corrosion, which consists of, at most, 20 atomic percent of at least one element selected from the group of Fe, Co, Ni and Cu and at least 7 atomic percent and less than 75 atomic percent of the sum of at least one element selected from Ta and Nb and at most 50 atomic percent of at least one element selected from the group of Mo and W, with the balance being substantially at least 25 atomic percent of Al.

(10) An amorphous alloy which is resistant to hot corrosion, which consists of, at most, 20 atomic percent of at least one element selected from the group of Fe, Co, Ni and Cu and less than 75 atomic percent of the sum of at least one element selected from the group of Ti and Zr and 7–50 atomic percent of at least one element selected from the group of Mo and W, with the balance being substantially at least 25 atomic percent of Al.

(11) An amorphous alloy which is resistant to hot corrosion, which consists of, at most, 20 atomic percent of at least one element selected from the group of Fe, Co, Ni and Cu and less than 75 atomic percent of the sum of at least one element selected from the group of Ti and Zr and at least 7 atomic percent of at least one element selected from the group of Ta and Nb, with the balance being substantially at least 25 atomic percent of Al.

(12) An amorphous alloy which is resistant to hot corrosion, which consists of, at most, 20 atomic percent of at least one element selected from the group of Fe, Co, Ni and Cu and less than 75 atomic percent of the sum of at least one element selected from the group of Ti and Zr and at least 7 atomic percent of the sum of at least one element selected from the group of Ta and Nb and, at most, 50 atomic percent of at least one element selected from the group of Mo and W, with the balance being substantially at least 25 atomic percent of Al.

(13) An amorphous alloy which is resistant to hot corrosion, which consists of, at most, 50 atomic percent of the sum of Cr and at least 7 atomic percent of at least one element selected from the group of Mo and W, with the balance being substantially Al.

(14) An amorphous alloy which is resistant to hot corrosion, which consists of, at most, 75 atomic percent of the sum of at most 50 atomic percent of Cr and at least 7 atomic percent of at least one element selected from the group of Ta and Nb, with the balance being substantially Al.

(15) An amorphous alloy which is resistant to hot corrosion, which consists of, at most, 75 atomic percent of the sum of Cr and at least 7 atomic percent of the sum of at least one element selected from the group of Ta and Nb and at least one element selected from the group of Mo and W, with the sum of Cr and at least one element selected from the group of Mo and W being at most 50 atomic percent and with the balance being substantially Al.

(16) An amorphous alloy which is resistant to hot corrosion, which consists of, at most, 75 atomic percent of the sum of at least one element selected from the group of Ti and Zr and, at most, 50 atomic percent of the sum of Cr and at least 7 atomic percent of at least one element selected from the group of Mo and W, with the balance being substantially Al.

(17) An amorphous alloy which is resistant to hot corrosion, which consists of, at most, 75 atomic percent of the sum of, at most, 50 atomic percent of Cr, at least one element selected from the group of Ti and Zr and at least 7 atomic percent of at least one element selected from the group of Ta and Nb, with the balance being substantially Al.

(18) An amorphous alloy which is resistant to hot corrosion, which consists of, at most, 75 atomic percent of the sum of Cr, at least one element selected from the group of Ti and Zr and at least 7 atomic percent of the sum of at least one element selected from the group of Ta and Nb and at least one element selected from the group of Mo and W, with the sum of Cr and at least one element selected from the group of Mo and W being, at most, 50 atomic percent and with the balance being substantially Al.

(19) An amorphous alloy which is resistant to hot corrosion, which consists of, at most, 20 atomic percent of at least one element selected from the group of Fe, Co, Ni and Cu and, at most, 50 atomic percent of the sum of Cr and at least 7 atomic percent of at least one element selected from the group of Mo and W, with the balance being substantially Al.

(20) An amorphous alloy which is resistant to hot corrosion, which consists of, at most, 20 atomic percent of at least one element selected from the group of Fe, Co, Ni and Cu and less than 75 atomic percent of the sum of, at most, 50 atomic percent of Cr and at least 7 atomic percent of at least one element selected from the group of Ta and Nb, with the balance being substantially at least 25 atomic percent of the sum of Cr and Al.

(21) An amorphous alloy which is resistant to hot corrosion, which consists of, at most, 20 atomic percent of at least one element selected from the group of Fe, Co, Ni and Cu and less than 75 atomic percent of the sum of Cr and at least 7 atomic percent of the sum of at least one element selected from the group of Ta and Nb and at least one element selected from Mo and W, with the sum of Cr and at least one element selected from the group of Mo and W being at most 50 atomic percent and with the balance being substantially at least 25 atomic percent of the sum of Cr and Al.

(22) An amorphous alloy which is resistant to hot corrosion, which consists of, at most, 20 atomic percent of at least one element selected from the group of Fe, Co, Ni and Cu and less than 75 atomic percent of the sum of at least one element selected from the group of Ti and Zr and, at most, 50 atomic percent of the sum of Cr and at least 7 atomic percent of at least one element selected from the group of Mo and W, with the balance being substantially at least 25 atomic percent of the sum of Cr and Al.

(23) An amorphous alloy which is resistant to hot corrosion, which consists of, at most, 20 atomic percent of at least one element selected from the group of Fe, Co, Ni and Cu and less than 75 atomic percent of the sum of, at most, 50 atomic percent of Cr, at least one element selected from the group of Ti and Zr and at least 7 atomic percent of at least one element selected from the group of Ta and Nb, with the balance being substantially at least 25 atomic percent of the sum of Cr and Al.

(24) An amorphous alloy which is resistant to hot corrosion, which consists of, at most, 20 atomic percent of at least one element selected from the group of Fe, Co, Ni and Cu and less than 75 atomic percent of the sum of Cr, at least one element selected from the group of Ti and Zr and at least 7 atomic percent of the sum of at least one element selected from the group of Ta and Nb and at least one element selected from Mo and W, with the sum of Cr and at least one element selected from the group of Mo and W being at most 50 atomic percent and with the balance being substantially at least 25 atomic percent of the sum of Cr and Al.

(25) An amorphous alloy which is resistant to hot corrosion, which consists of 25–70 atomic percent of at least one element selected from the group of Ta and Nb, with the balance being substantially Cr.

(26) An amorphous alloy which is resistant to hot corrosion, which consists of, at most, 70 atomic percent of the sum of at least one element selected from the group of Ti and Zr and at least 9 atomic percent of at least one element selected from the group of Ta and Nb, with the balance being substantially Cr.

(27) An amorphous alloy which is resistant to hot corrosion, which consists of, at most, 20 atomic percent of at least one element selected from the group of Fe, Co, Ni and Cu and at least 25 atomic percent and less than 70 atomic percent of at least one element selected from Ta and Nb, with the balance being substantially at least 30 atomic percent of Cr.

(28) An amorphous alloy which is resistant to hot corrosion, which consists of, at most, 20 atomic percent of at least one element selected from the group of Fe, Co, Ni and Cu and at least 25 atomic percent and less than 70 atomic percent of the sum of at least one element selected from the group of Ti and Zr and at least 9 atomic percent of at least one element selected from the group of Ta and Nb, with the balance being substantially at least 30 atomic percent of Cr.

(29) An amorphous alloy which is resistant to hot corrosion, which consists of at least 25 atomic percent and less than 70 atomic percent of at least one element selected from the group of Ta and Nb and, at most, 75 atomic percent of the sum of Cr and at least one element selected from the group of Mo and W, with the balance being substantially at least 30 atomic percent of Cr.

(30) An amorphous alloy which is resistant to hot corrosion, which consists of at least 25 atomic percent and less than 70 atomic percent of the sum of at least one element selected from the group of Ti and Zr and at least one element selected from the group of Ta and Nb, and at least 9 atomic percent of the sum of at least one element selected from the group of Mo and W and at least one element selected from Ta and Nb, with the sum of Cr and at least one element selected from the group of Mo and W being at most 75 atomic percent and with the balance being substantially at least 30 atomic percent of Cr.

(31) An amorphous alloy which is resistant to hot corrosion, which consists of, at most, 20 atomic percent of at least one element selected from the group of Fe, Co, Ni and Cu, at least 25 atomic percent and less than 70 atomic percent of the sum of at least one element selected from the group of Ti and Zr and at least one element selected from Ta and Nb, and at least 9 atomic percent of the sum of at least one element selected from the group of Mo and W and at least one element selected from the group of Ta and Nb, with the sum of Cr and at least one element selected from the group of Mo and W being less than 75 atomic percent and with the balance being substantially at least 30 atomic percent of Cr.

(32) An amorphous alloy which is resistant to hot corrosion, which consists of at least 25–61 atomic percent of at least one element selected from the group of Ti and Zr and at least 9 atomic percent of at least one element selected from the group of Mo and W, with the balance being substantially at least 30 atomic percent of Cr.

(33) An amorphous alloy which is resistant to hot corrosion, which consists of, at most, 20 atomic percent of at least one element selected from the group of Fe, Co, Ni and Cu, at least 25 atomic percent and less than 61 atomic percent of at least one element selected from the group of Ti and Zr and at least 9 atomic percent of at least one element selected from the group of Mo and W, with the balance being substantially at least 30 atomic percent of Cr.

(34) An amorphous alloy which is resistant to hot corrosion, which consists of, at most, 50 atomic percent of Si and 7–50 atomic percent of at least one element selected from the group of Mo and W, with the balance being substantially at least 10 atomic percent of Al.

(35) An amorphous alloy which is resistant to hot corrosion, which consists of, at most, 50 atomic percent of Si and, at most, 50 atomic percent of the sum of Cr and at least 7 atomic percent of at least one element selected from the group of Mo and W, with the balance being substantially at least 10 atomic percent of Al.

(36) An amorphous alloy which is resistant to hot corrosion, which consists of, at most, 20 atomic percent of at least one element selected from the group of Fe, Co, Ni and Cu, at most, 50 atomic percent of Si and at least 7 atomic percent and less than 50 atomic percent of at least one element selected from the group of Mo and W, with the sum of Si and the substantial balance of at least 10 atomic percent of Al being at least 30 atomic percent.

(37) An amorphous alloy which is resistant to hot corrosion, which consists of, at most, 20 atomic percent of at least one element selected from the group of Fe, Co, Ni and Cu, at most, 50 atomic percent of Si and less than 50 atomic percent of the sum of Cr and at least 7 atomic percent of at least one element selected from the group of Mo and W, with the sum of Si and the substantial balance of at least 10 atomic percent of Al being at least 30 atomic percent.

(38) An amorphous alloy which is resistant to hot corrosion, which consists of, at most, 50 atomic percent of Si and 7–75 atomic percent of at least one element selected from the group of Ta and Nb, with the balance being substantially at least 10 atomic percent of one element selected from the group of Al and Cr.

(39) An amorphous alloy which is resistant to hot corrosion, which consists of, at most, 50 atomic percent of Si and 7–75 atomic percent of the sum of at least one element selected from the group of Ta and Nb and at least one element selected from Mo and W, with the balance being substantially at least 10 atomic percent of one element selected from the group of Al and Cr and with the sum of Cr and at least one element selected from the group of Mo and W being, at most, 50 atomic percent.

(40) An amorphous alloy which is resistant to hot corrosion, which consists of, at most, 50 atomic percent of Si and at most 75 atomic percent of the sum of at least one element selected from the group of Ti and Zr and 7–50 atomic percent of at least one element selected from Mo and W, with the balance being substantially at least 10 atomic percent of one element selected from the group of Al and Cr and with the sum of Cr and at least one element selected from the group of Mo and W being, at most, 50 atomic percent.

(41) An amorphous alloy which is resistant to hot corrosion, which consists of, at most, 50 atomic percent of Si and, at most, 75 atomic percent of the sum of at least one element selected from the group of Ti and Zr and at least 7 atomic percent of at least one element selected from the group of Ta and Nb, with the balance being substantially at least 10 atomic percent of one element selected from the group of Al and Cr.

(42) An amorphous alloy which is resistant to hot corrosion, which consists of, at most, 50 atomic percent of Si and, at most, 75 atomic percent of the sum of at least one element selected from the group of Ti and Zr and at least 7 atomic percent of the sum of at least one element selected from the group of Ta and Nb and, at most, 50 atomic percent of at least one element selected from Mo and W, with the balance being substantially at least 10 atomic percent of one element selected from the group of Al and Cr and with the sum of Cr and at least one element selected from the group of Mo and W being, at most, 50 atomic percent.

(43) An amorphous alloy which is resistant to hot corrosion, which consists of, at most, 20 atomic percent of at least one element selected from the group of Fe, Co, Ni and Cu, at most, 50 atomic percent of Si and at least 7 atomic percent and less than 75 atomic percent of at least one element selected from the group of Ta and Nb, with the sum of Si and the substantial balance of at least 10 atomic percent of one element selected from the group of Al and Cr being at least 25 atomic percent.

(44) An amorphous alloy which is resistant to hot corrosion, which consists of, at most, 20 atomic percent of at least one element selected from the group of Fe, Co, Ni and Cu, at most, 50 atomic percent of Si and at least 7 atomic percent and less than 75 atomic percent of the sum of at least one element selected from the group of Ta and Nb and, at most, 50 atomic percent of at least one element selected from the group of Mo and W, with the sum of Si and the substantial balance of at least 10 atomic percent of one element selected from the group of Al and Cr being at least 25 atomic percent and with the sum of Cr and at least one element selected from the group of Mo and W being, at most, 50 atomic percent.

(45) An amorphous alloy which is resistant to hot corrosion, which consists of, at most, 20 atomic percent of at least one element selected from the group of Fe, Co, Ni and Cu, at most, 50 atomic percent of Si and less than 75 atomic percent of the sum of at least one element selected from the group of Ti and Zr and 7–50 atomic percent of at least one element selected from Mo and W, with the sum of Si and the substantial balance of at least 10 atomic percent of one element selected from the group of Al and Cr being at least 25 atomic percent and with the sum of Cr and at least one element selected from the group of Mo and W being, at most, 50 atomic percent.

(46) An amorphous alloy which is resistant to hot corrosion, which consists of, at most, 20 atomic percent of at least one element selected from the group of Fe, Co, Ni and Cu, at most, 50 atomic percent of Si and less than 75 atomic percent of the sum of at least one element selected from the group of Ti and Zr and at least 7 atomic percent of at least one element selected from the group of Ta and Nb, with the sum of Si and the substantial balance of at least 10 atomic percent of one element selected from the group of Al and Cr being at least 25 atomic percent.

(47) An amorphous alloy which is resistant to hot corrosion, which consists of, at most, 20 atomic percent of at least one element selected from the group of Fe, Co, Ni and Cu, at most, 50 atomic percent of Si and less than 75 atomic percent of the sum of at least one element selected from the group of Ti and Zr and at least 7 atomic percent of the sum of at least one element selected from the group of Ta and Nb and, at most, 50 atomic percent of at least one element selected from the group of Mo and W, with the sum of Si and the substantial balance of at least 10 atomic percent of one element selected from the group of Al and Cr being at least 25 atomic percent and with the sum of Cr and at least one element selected from the group of Mo and W being, at most, 50 atomic percent.

DETAILED DESCRIPTION OF THE PREFERRED EMBODIMENTS

Figure 1:
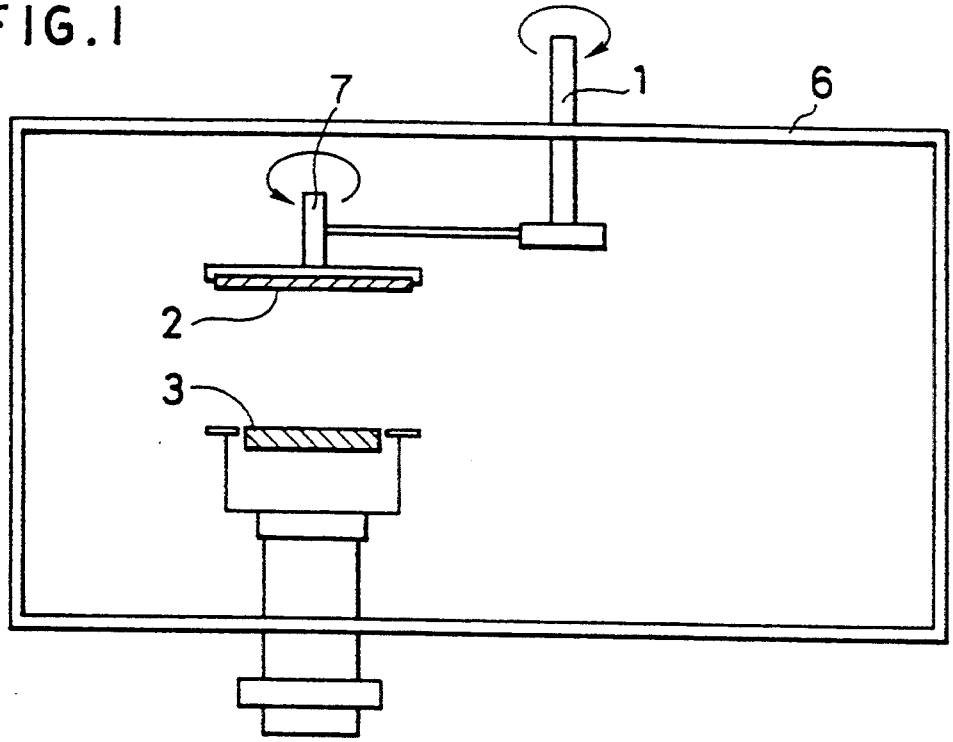
FIGS. 1 and 2 show apparatuses for preparing an alloy of the present invention.

The present invention aims to provide novel amorphous alloys which are resistant to hot corrosion in both sulfidizing and oxidizing atmospheres.

It is generally known that an alloy has a crystalline structure in the solid state. However, an alloy having a specific composition becomes amorphous by prevention of the formation of a long-range ordered structure during solidification through, for example, rapid solidification from the liquid state, sputter deposition or plating under specified conditions. The amorphous alloy thus formed is a homogeneous single phase supersaturated solid solution containing sufficient amounts of various alloying elements which are beneficial in providing specific characteristics, such as a high resistance to hot corrosion.

The present inventors and coworkers carried out a series of investigations paying their attention to the outstanding properties of amorphous alloys. They found that amorphous alloys consisting of metals having high melting points and metals having low boiling points can be prepared by the sputter deposition method, which does not require mixing of metallic elements by melting. The alloys of the present invention have been accomplished on the basis of this finding.

Furthermore, the present inventors and coworkers found that the alloys of the present invention possess and extremely high resistance to hot corrosion due to the formation of protective scales in both sulfidizing and oxidizing atmospheres.

Table 1 shows the components and compositions of the alloys set forth in the Claim.

TABLE 1

| | Composition of alloys (atomic percent) | | | | | | | |
|---|---|---|---|---|---|---|---|---|
| No. | Mo, W (*1) | Ta, Nb (*2) | Zr, Ti (*3) | Fe, Co, Ni, Cu (*4) | Si | Cr (*5) | Al (*6) | Cr, Al (*7) |
| 1 | 7–50 | | | | | | Balance | |
| 2 | | 7–75 | | | | | Balance | |
| 3 | ≦50 | 7–75 (*8) | | | | | Balance | |

TABLE 1-continued

| | Composition of alloys (atomic percent) | | | | | | | |
|---|---|---|---|---|---|---|---|---|
| No. | Mo, W (*1) | Ta, Nb (*2) | Zr, Ti (*3) | Fe, Co, Ni, Cu (*4) | Si | Cr (*5) | Al (*6) | Cr, Al (*7) |
| 4 | 7–50 | | ≦75 (*9) | | | | Balance | |
| 5 | | 7≦ | ≦75 (*10) | | | | Balance | |
| 6 | ≦50 | 7≦ (*8) | ≦75 (*11) | | | | Balance | |
| 7 | 7≦ and <50 | | | ≦20 | | | Balance | |
| 8 | | 7≦ and <75 | | ≦20 | | | 25≦ | |
| 9 | ≦50 | 7≦ and <75 (*8) | | ≦20 | | | 25≦ | |
| 10 | 7–50 | | <75 (*9) | ≦20 | | | 25≦ | |
| 11 | | 7≦ | <75 (*10) | ≦20 | | | 25≦ | |
| 12 | ≦50 | 7≦ (*8) | <75 (*11) | ≦20 | | | 25≦ | |
| 13 | 7≦ | | | | | ≦50 (*12) | Balance | |
| 14 | | 7 (*2)–75 (*13) | | | | ≦50 | Balance | |
| 15 | ≦50 (*14) | 7 (*15)–75 (*16) | | | | | Balance | |
| 16 | 7≦ | | ≦75 (*17) | | | ≦50 (*12) | Balance | |
| 17 | | 7≦ | ≦75 (*18) | | | ≦50 | Balance | |
| 18 | ≦50 (*14) | 7 ≦ (*15) | ≦75 (*19) | | | | Balance | |
| 19 | 7≦ | | | ≦20 | | ≦50 (*12) | Balance | |
| 20 | | 7 (*2) ≦ and <75 (*13) | | ≦20 | | ≦50 | 25≦ (*20) | |
| 21 | ≦50 (*14) | 7 (*15) ≦ and <75 (*16) | | ≦20 | | | 25≦ (*20) | |
| 22 | 7≦ | | <75 (*17) | ≦20 | | ≦50 (*12) | 25≦ (*20) | |
| 23 | | 7≦ | <75 (*18) | ≦20 | | ≦50 | 25≦ (*20) | |
| 24 | ≦50 (*14) | 7≦ (*15) | <75 (*19) | ≦20 | | | 25≦ (*20) | |
| 25 | | 25–70 | | | | Balance | | |
| 26 | | 9≦ | 25–70 (*21) | | | Balance | | |
| 27 | | 25≦ and <70 | | ≦20 | | 30≦ | | |
| 28 | | 9≦ | 25≦ and <70 (*21) | ≦20 | | 30≦ | | |
| 29 | ≦75 (*22) | 25≦ and <70 | | | | 30≦ | | |
| 30 | ≦75 (*22) | 9≦ (*23) | 25≦ and <70 (*24) | | | 30≦ | | |
| 31 | <75 (*22) | 9≦(*23) | 25≦ and <70 (*24) | ≦20 | | 30≦ | | |
| 32 | 9≦ | | 25–61 | | | 30≦ | | |
| 33 | 9≦ | | 25≦ and <61 | ≦20 | | 30≦ | | |
| 34 | 7–50 | | | | ≦50 | | 10≦ | |
| 35 | 7≦ | | | | ≦50 | ≦50 (*12) | 10≦ | |
| 36 | 7≦ and <50 | | | ≦20 | ≦50 | | 10≦ (*25) | |
| 37 | 7≦ | | | ≦20 | ≦50 | ≦50 (*12) | 10≦ (*25) | |
| 38 | | 7–75 | | | ≦50 | | | 10≦ |
| 39 | ≦50 (*14) | 7–75 (*15) | | | ≦50 | | | 10≦ |
| 40 | 7 (*1)–50 (*14) | | ≦75 (*26) | | ≦50 | | | 10≦ |
| 41 | | 7≦ | ≦75 (*10) | | ≦50 | | | 10≦ |
| 42 | ≦50 (*14) | 7≦ (*15) | ≦75 (*27) | | ≦50 | | | 10≦ |
| 43 | | 7≦ and <75 | | ≦20 | ≦50 | | | 10≦ (*28) |
| 44 | ≦50 (*14) | 7≦ and <75 (*15) | | ≦20 | ≦50 | | | 10≦ (*28) |
| 45 | 7 (*1)–50 (*14) | | <75 (*26) | ≦20 | ≦50 | | | 10≦ (*28) |
| 46 | | 7≦ | <75 (*10) | ≦20 | ≦50 | | | 10≦ (*28) |

TABLE 1-continued

| | Composition of alloys (atomic percent) | | | | | | | |
|---|---|---|---|---|---|---|---|---|
| No. | Mo, W (*1) | Ta, Nb (*2) | Zr, Ti (*3) | Fe, Co, Ni, Cu (*4) | Si | Cr (*5) | Al (*6) | Cr, Al (*7) |
| 47 | ≦50 (*14) | 7≦ (*15) | <75 (*27) | ≦20 | ≦50 | | | 10≦ (*28) |

*1: At least one element selected from Mo and W.
*2: At least one element selected from Ta and Nb.
*3: At least one element selected from Ti and Zr.
*4: At least one element selected from the group of Fe, Co, Ni and Cu.
*5: Substantial balance, Cr.
*6: Substantial balance, Al.
*7: Substantial balance, at least one element selected from Cr and Al.
*8: The sum of at least one element selected from Ta and Nb and at most 50 atomic percent of at least one element selected from Mo and W.
*9: The sum of at least one element selected from Ti and Zr and 7-50 atomic percent of at least one element selected from Mo and W.
*10: The sum of at least one element selected from Ti and Zr and at least 7 atomic percent of at least one element selected from Ta and Nb.
*11: The sum of at least one element selected from Ti and Zr and at least 7 atomic percent of the sum of at least one element selected from Nb and Ta and at most 50 atomic percent of at least one element selected from Mo and W.
*12: The sum of Cr and at least 7 atomic percent of at least one element selected from Mo and W.
*13: The sum of at most 50 atomic percent of Cr and at least 7 atomic percent of at least one element selected from Nb and Ta.
*14: The sum of Cr and at least one element selected from Mo and W.
*15: The sum of at least one element selected from Ta and Nb and at least one element selected from Mo and W.
*16: The sum of Cr and at least 7 atomic percent of the sum of at least one element selected from Mo and W and at least one element selected from Nb and Ta, with the sum of Cr and at least one element selected from Mo and W being at most 50 atomic percent.
*17: The sum of at least one element selected from Ti and Zr and at most 50 atomic percent of the sum of Cr and at least 7 atomic percent of at least one element selected from Mo and W.
*18: The sum of at most 50 atomic percent of Cr, at least one element selected from Ti and Zr and at least 7 atomic percent of at least one element selected from Ta and Nb.
*19: The sum of Cr, at least one element selected from Ti and Zr and at least 7 atomic percent of the sum of at least one element selected from Ta and Nb and at least one element selected from Mo and W, with the sum of Cr and at least one element selected from Mo and W being at most 50 atomic percent.
*20: The sum of Al and Cr.
*21: The sum of at least one element selected from Ti and Zr and at least 9 atomic percent of at least one element selected from Nb and Ta.
*22: The sum of at least 30 atomic percent of Cr and at least one element selected from Mo and W.
*23: The sum of at least one element selected from Ta and Nb and at least one element selected from Mo and W.
*24: The sum of at least one element selected from Ti and Zr and at least one element selected from Nb and Ta.
*25: Substantial balacne, Al, with the sum of Al and Si being at least 30 atomic percent.
*26: The sum of at least one element selected from Ti and Zr and at least one element selected from Mo and W.
*27: The sum of at least one element selected from Ti and Zr and at least 7 atomic percent of at least one element selected from Nb and Ta and at least one element selected from Mo and W.
*28: Substantial balance, one element selected from Al and Cr with the sum of Si and at least one element selected from Al and Cr being at least 25 atomic percent.

The amorphous alloys produced by sputter deposition are single phase alloys in which the alloying elements exist in a state of a uniform solid solution. Accordingly, they form extremely uniform and highly corrosion-resistant protective scales in hot corrosion atmospheres at high temperatures.

However, it is not desirable to add various alloying elements in large quantities to a crystalline metal, because the resulting alloy is of a multiple phase mixture, with each phase having different chemical properties, and is not so satisfactory in hot corrosion resistance as intended. Moreover, the chemical heterogeneity is rather harmful to hot corrosion resistance.

By contrast, the amorphous alloys of this invention are of a homogeneous solid solution. Therefore, they homogeneously contain effective elements as much as required to form a uniform stable and protective scale depending upon the compositions of gas atmospheres. Owing to the formation of this uniform scale, the amorphous alloys of this invention exhibit a sufficiently high hot corrosion resistance.

In other words, metallic materials to withstand hot corrosion atmospheres should form a uniform, stable and protective scale in such environments. Alloys of amorphous structure permit many alloying elements to exist in a form of single phase solid solution, and also permit the formation of a uniform scale.

The components and compositions of the alloys of this invention are specified as above for the following reasons:

Al and Cr form protective oxide scales in an oxidizing atmosphere and hence the alloys in the present invention must contain at least 25 atomic percent of at least one element selected from the group of Al and Cr, unless Si is added. Si enhances the protective quality of the oxide scales, and hence, when Si is added, the formation of the protective oxide scale requires at least 10 atomic percent of at least one element selected from the group of Al and Cr. Sulfidation resistance is provided by alloying with Mo, W, Nb and Ta and, accordingly, the alloys in the present invention must contain at least one element selected from the group of Mo, W, Nb and Ta.

Mo, W, Ta, Nb, Ti, Zr and Cr are able to form an amorphous structure when they coexist with Al. Similarly, Ta, Nb, Ti, Zr and Al can form amorphous alloys with Cr. For the formation of the amorphous structure by sputtering, the Al alloys are required to consist of 7–50 atomic percent of at least one element selected from the group of Cr, Mo and W, and similarly, the Al alloys are required to consist of 7–75 atomic percent of at least one element selected from the group of Ta and Nb. When the alloys consist of Al, at least one element selected from the group of Ta and Nb and at least one element selected from the group of Mo and W, the content of at least one element selected from the group of Cr, Mo and W is not allowed to exceed 50 atomic percent, and the sum of at least one element selected from the group of Ta and Nb and at least one element selected from group of Cr, Mo and W is required to be 7–75 atomic percent for the formation of the amorphous structure by sputtering.

A portion of Cr, Mo, W, Nb and Ta in the Al-refractory metal alloys can be substituted with Ti and Zr for amorphous alloy formation, but at least 7 atomic percent of at least one element selected from the group of Mo, W, Nb and Ta should be contained for the formation of the protective scale in sulfidizing atmospheres.

For the formation of the amorphous structure of Cr alloys by sputtering, the alloys consisting of Cr and at least one element selected from the group of Ta and Nb are required to consist of 25–70 atomic percent of at least one element selected from the group of Ta and Nb. A portion of Nb and Ta in the Cr-refractory metal alloys can be substituted with Ti and Zr for amorphous alloy formation, but at least 25 atomic percent of at least one element selected from the group of Nb and Ta should be contained for the formation of the protective scale in sulfidizing atmospheres. A portion of Cr in Cr-refractory metal alloys can be substituted with Mo and W for the formation of the amorphous structure, and the addition of Mo and/or W improves the sulfidation resistance. However, Cr is necessary for oxidation resistance and hence, when Cr is substituted with at least one element selected from the group of Mo and W, at least 30 atomic percent of Cr must be contained unless Al is added.

Fe, Co, Ni and Cu can be substituted for refractory metals. However, excess additions of these elements decreases sulfidation resistance and hence at least one element selected from this group must be at most 20 atomic percent.

Preparation of the alloys of the present invention is carried out by sputter deposition method. Sputtering is performed by using a sintered or alloyed crystalline target of multiple phases whose average composition is the same as the amorphous alloy to be prepared. Sputtering is also performed by using a target consisting of a metal sheet of one of constituents in the amorphous alloy to be prepared and other metal constituents placed on the metal sheet.

In the present invention, it is difficult to form alloy targets of aluminum and/or chromium with refractory metals, and hence targets consisting of an Al or Cr disc on which various alloying elements are placed are used. The apparatus shown in FIG. 1 can be used. In order to avoid local compositional heterogeneity of sputtered alloys, it is desirable to carry out the revolution of the substrate disc 2 around a central axis 1 of the sputtering chamber 6 in addition to the revolution of the substrate disc itself around the central axis 7 of the substrate disc. The orbit of the substrate disc is just above the center of the target 3.

Figure 2:
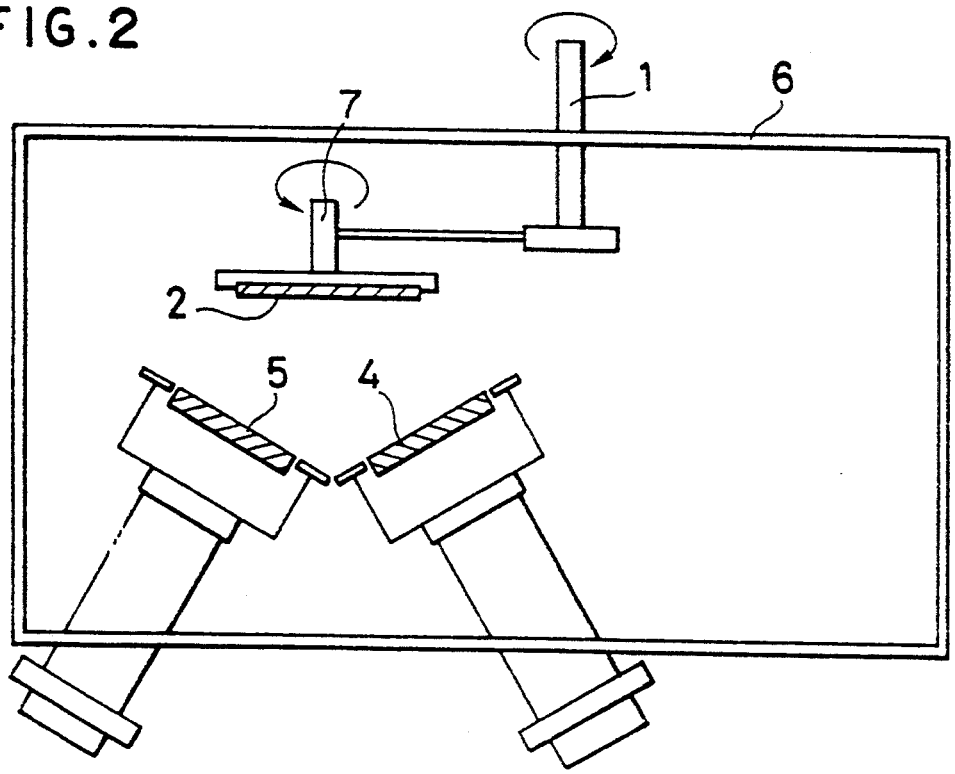

In order to widely vary the composition of the amorphous alloy formed, the apparatus shown in FIG. 2 can be used. For instance, if an Al disc is used as a target 4, a Mo-placed Al disc is used as a target 5. These two targets are installed obliquely in the sputtering chamber 6, in such a way that the intersection of the normals to the centers of these two targets is on the orbit of the center of the substrate disc 2 revolving around a central axis 1 of the sputtering chamber 6, in addition to revolving the substrate disc itself around the central axis 7 of the substrate disc. When these two targets are independently operated by two independent power sources, amorphous Al-Mo alloys are formed whose compositions are dependent upon the relative powers of two targets. In this manner, when different various combinations of two targets are used, different amorphous alloys are formed.

The invention is now illustrated by the following examples:

EXAMPLE 1

The target consisted of 4 Mo discs of 20 mm diameter and 1.5 mm thickness placed symmetrically on an Al disc of 100 mm diameter and 6 mm thickness so as to place the center of Mo discs on a concentric circle of 58 mm diameter on the surface of the Al disc. The sputtering apparatus shown in FIG. 1 was used. Substrates were a stainless steel and two quartz sheets which revolved around the central axis of the sputtering chamber during the revolution of the substrates themselves around the center of the substrates. Sputtering was carried out at a power of 640 watts under purified Ar stream of 5 ml/min at a vacuum of $1\times10^{-3}$ Torr.

X-ray diffraction of the sputter deposit thus prepared revealed the formation of an amorphous alloy. Electron probe microanalysis showed that the amorphous alloy consisted of Al-34 at%Mo alloy.

When the alloy was exposed to air at 750° C., the parabolic rate constant for oxidation was $3\times10^{-15}$ $g^2cm^{-4}s^{-1}$. When the alloy was exposed to sulfur vapor at $10^{-2}$ Torr at 950° C., the parabolic rate constant for sulfidation was $1\times10^{-11}$ $g^2cm^{-4}s^{-1}$.

Consequently, the amorphous alloy has an extremely high resistance to hot corrosion.

EXAMPLE 2

The sputtering apparatus shown in FIG. 2 was used in which Al and Nb target discs of 100 mm diameter and 6 mm thickness were installed. The substrates were a stainless steel disc and two quartz sheets which revolved around the central axis of the sputtering chamber during the revolution of the substrates themselves around the center of the substrates. Sputtering was carried out under a purified Ar stream of 5 ml/min at a vacuum of $1\times10^{-3}$ Torr.

X-ray diffraction of the sputter deposit thus prepared revealed the formation of an amorphous alloy. Electron probe microanalysis showed that the amorphous alloy consisted of Al-40 at%Nb alloy.

When the alloy was exposed to air at 950° C., the weight gain followed the parabolic rate law. The parabolic rate constant for oxidation was $5\times10^{-13}$ $g^2cm^{-4}s^{-1}$. When the alloy was exposed to sulfur vapor at $10^{-2}$ Torr at 950° C. the parabolic rate constant for sulfidation was $3\times10^{-11}$ $g^2cm^{-4}s^{-1}$.

Consequently, the amorphous alloy has an extremely high resistance to hot corrosion.

EXAMPLE 3

The target consisted of 4 Ta discs of 20 mm diameter and 1.5 mm thickness placed symmetrically on a Cr disc of 100 mm diameter and 6 mm thickness so as to place the center of Ta discs on a concentric circle of 58 mm diameter on the surface of the Cr disc. The sputtering apparatus shown in FIG. 1 was used. The substrates were an stainless steel and two quartz sheets which revolved around the central axis of the sputtering chamber during the revolution of the substrates themselves around the center of the substrates. Sputtering was carried out under a purified Ar stream of 5 ml/min at a vacuum of $1\times10^{-3}$ Torr.

X-ray diffraction of the sputter deposit thus prepared revealed the formation of an amorphous alloy. Electron probe microanalysis showed that the amorphous alloy consisted of Cr-43 at%Ta alloy.

When the alloy was exposed to air at 950° C., the parabolic rate constant for oxidation was $2\times10^{-11}$ $g^2cm^{-4}s^{-1}$. When the alloy was exposed to sulfur vapor at $10^{-2}$ Torr at 950° C., the parabolic rate constant for sulfidation was $7\times10^{-10}$ $g^2cm^{-4}s^{-1}$.

Consequently, the amorphous alloy has an extremely high resistance to hot corrosion.

EXAMPLE 4

The sputtering apparatus shown in FIG. 2 was used in which Cr and Nb target discs of 100 mm diameter and 6 mm thickness were installed. The substrates were a stainless steel and two quartz sheets which revolved around the central axis of the sputtering chamber during a revolution of the substrates themselves around the center of the substrates. Sputtering was carried out under a purified Ar stream of 5 ml/min at a vacuum of $1\times10^{-3}$ Torr.

X-ray diffraction of the sputter deposit thus prepared revealed the formation of an amorphous alloy. Electron probe microanalysis showed that the amorphous alloy consisted of Cr-35 at%Nb alloy.

When the alloy was exposed to air at 950° C., the parabolic rate constant for oxidation was $1\times10^{-11}$ $g^2cm^{-4}s^{-1}$. When the alloy was exposed to sulfur vapor at $10^{-2}$ Torr at 950° C., the parabolic rate constant for sulfidation was $6\times10^{-10}$ $g^2cm^{-4}s^{-1}$.

Consequently, the amorphous alloy has an extremely high resistance to hot corrosion.

EXAMPLE 5

The target consisted of 3 Ta discs of 20 mm diameter and 1.5 mm thickness and 3 Si pieces of 15 mm×15 mm, both of which were placed symmetrically on an Al-15 at%Si alloy disc of 100 mm diameter and 6 mm thickness so as to place the center of Ta discs and Si pieces on a concentric circle of 58 mm diameter on the surface of the Al-15 at%Si alloy disc. The sputtering apparatus shown in FIG. 1 was used. The substrates were an stainless steel and two quartz sheets which revolved around the central axis of the sputtering chamber during the revolution of the substrates themselves around the center of the substrates. Sputtering was carried out under a purified Ar stream of 5 ml/min at a vacuum of $1\times10^{-3}$ Torr.

X-ray diffraction of the sputter deposit thus prepared revealed the formation of an amorphous alloy. Electron probe microanalysis showed that the amorphous alloy consisted of Al-33 at%Mo-16 at%Si alloy.

When the alloy was exposed to air at 900° C., the parabolic rate constant for oxidation was $7.3\times10^{-14}$ $g^2cm^{-4}s^{-1}$. When the alloy was exposed to sulfur vapor at $10^{-2}$ Torr at 900° C., the parabolic rate constant for sulfidation was $3\times10^{-12}$ $g^2cm^{-4}s^{-1}$.

Consequently, the amorphous alloy has an extremely high resistance to hot corrosion.

EXAMPLE 6

The sputtering apparatus shown in FIG. 2 was used in which a Nb target disc of 100 mm diameter and 6 mm thickness and a target consisting of 3 Si pieces of 15 mm×15 mm placed symmetrically on an Al-15 at%Si alloy disc were installed. The substrates were a stainless steel and two quartz sheets which revolved around the central axis of the sputtering chamber during the revolution of the substrates themselves around the center of the substrates. Sputtering was carried out under a purified Ar stream of 5 ml/min at a vacuum of $1\times10^{-3}$ Torr.

X-ray diffraction of the sputter deposit thus prepared revealed the formation of an amorphous alloy. Electron probe microanalysis showed that the amorphous alloy consisted of Al-28 at%Nb-14 at%Si alloy.

When the alloy was exposed to air at 900° C., the parabolic rate constant for oxidation was $1.7\times10^{-11}$ $g^2cm^{-4}s^{-1}$. When the alloy was exposed to sulfur vapor at $10^{-2}$ Torr at 900° C., the parabolic rate constant for sulfidation was $2.3\times10^{-12}$ $g^2cm^{-4}s^{-1}$.

Consequently the amorphous alloy has an extremely high resistance to hot corrosion.

EXAMPLE 7

The sputtering apparatus shown in FIG. 1 was used in which various targets were installed. Sputtering conditions and procedures similar to those described in Example 1 were applied. A variety of amorphous alloys shown in Table 2 were prepared. The fact that these alloys were all in the amorphous state was confirmed by X-ray diffraction.

The corrosion tests were carried out in air at 750° C. and in sulfur vapor at $10^{-2}$ Torr at 950° C.

Their parabolic rate constants for oxidation and sulfidation are extremely low as shown in Table 2.

Consequently these amorphous alloys are highly resistant to hot corrosion in sulfidizing and oxidizing atmospheres.

TABLE 2

Parabolic rate constants of oxidation at 750° C. in air and sulfidation at 950° C. under a sulfur pressure of $10^{-2}$ atm for amorphous alloys

| Alloy | Parabolic Rate Constant ($g^2cm^{-4}s^{-1}$) Oxidation | Sulfidation |
|---|---|---|
| Al—3Mo—4W | $1\times10^{-15}$ | $2\times10^{-10}$ |
| Al—25Mo—25W | $1\times10^{-14}$ | $1\times10^{-11}$ |
| Al—2Mo—1W—2Nb—2Ta | $1\times10^{-15}$ | $3\times10^{-10}$ |
| Al—25Mo—25W—12Nb—13Ta | $3\times10^{-14}$ | $7\times10^{-12}$ |
| Al—3Mo—4W—2Ti—3Zr | $1\times10^{-15}$ | $2\times10^{-10}$ |
| Al—3Mo—4W—34Ti—34Zr | $5\times10^{-14}$ | $5\times10^{-10}$ |
| Al—25Mo—25W—12Ti—13Zr | $8\times10^{-14}$ | $5\times10^{-12}$ |
| Al—2Mo—1W—2Nb—2Ta—2Ti—3Zr | $1\times10^{-15}$ | $4\times10^{-10}$ |
| Al—2Mo—1W—2Nb—2Ta—34Ti—34Zr | $5\times10^{-14}$ | $5\times10^{-10}$ |
| Al—2Mo—1W—30Nb—30Ta—6Ti—6Zr | $8\times10^{-14}$ | $5\times10^{-11}$ |
| Al—22Mo—23W—12Nb—13Ta—2Ti—3Zr | $9\times10^{-14}$ | $6\times10^{-12}$ |
| Al—3Mo—4W—5Fe—5Co—5Ni—5Cu | $1\times10^{-15}$ | $6\times10^{-9}$ |
| Al—25Mo—25W—5Fe—5Co—5Ni—5Cu | $5\times10^{-14}$ | $2\times10^{-10}$ |
| Al—25Mo—25W—2Nb—2Ta—5Fe—5Co—5Ni—5Cu | $4\times10^{-14}$ | $1\times10^{-10}$ |
| Al—2Mo—2W—25Nb—25Ta—5Fe—5Co—5Ni—5Cu | $2\times10^{-14}$ | $2\times10^{-10}$ |
| Al—13Mo—13W—13Nb—13Ta—5Fe—5Co—5Ni—5Cu | $3\times10^{-14}$ | $1\times10^{-10}$ |
| Al—25Mo—25W—2Ti—2Zr—5Fe—5Co—5Ni—5Cu | $5\times10^{-14}$ | $1\times10^{-10}$ |
| Al—2Mo—2W—25Ti—25Zr—5Fe—5Co—5Ni—5Cu | $1\times10^{-14}$ | $1\times10^{-9}$ |
| Al—13Mo—13W—13Ti—13Zr—5Fe—5Co—5Ni—5Cu | $3\times10^{-14}$ | $5\times10^{-10}$ |
| Al—3Mo—4W—3Nb—4Ta—20Ti—20Zr—5Fe—5Co—5Ni—5Cu | $4\times10^{-14}$ | $5\times10^{-10}$ |

TABLE 2-continued

Parabolic rate constants of oxidation at 750° C. in air and sulfidation at 950° C. under a sulfur pressure of $10^{-2}$ atm for amorphous alloys

| Alloy | Parabolic Rate Constant ($g^2cm^{-4}s^{-1}$) Oxidation | Sulfidation |
|---|---|---|
| Al—3Mo—4W—20Nb—20Ta—4Ti—4Zr—5Fe—5Co—5Ni—5Cu | $5 \times 10^{-14}$ | $2 \times 10^{-10}$ |
| Al—20Mo—20W—3Nb—4Ta—4Ti—4Zr—5Fe—5Co—5Ni—5Cu | $7 \times 10^{-14}$ | $1 \times 10^{-10}$ |
| Al—43Cr—3Mo—4W | $3 \times 10^{-15}$ | $7 \times 10^{-9}$ |
| Al—10Cr—20Mo—20W | $1 \times 10^{-14}$ | $1 \times 10^{-11}$ |
| Al—46Cr—2Mo—2W—2Nb—2Ta | $2 \times 10^{-15}$ | $7 \times 10^{-9}$ |
| Al—43Cr—3Mo—4W—12Nb—13Ta | $5 \times 10^{-14}$ | $5 \times 10^{-10}$ |
| Al—10Cr—20Mo—20W—12Nb—13Ta | $8 \times 10^{-14}$ | $1 \times 10^{-11}$ |
| Al—43Cr—3Mo—4W—12Ti—13Zr | $3 \times 10^{-14}$ | $4 \times 10^{-9}$ |
| Al—10Cr—20Mo—20W—12Ti—13Zr | $9 \times 10^{-14}$ | $5 \times 10^{-11}$ |
| Al—46Cr—2Mo—2W—2Nb—2Ta—10Ti—10Zr | $4 \times 10^{-14}$ | $5 \times 10^{-9}$ |
| Al—10Cr—20Mo—20W—10Nb—10Ta—2Ti—3Zr | $9 \times 10^{-14}$ | $5 \times 10^{-11}$ |
| Al—43Cr—3Mo—4W—5Fe—5Co—5Ni—5Cu | $2 \times 10^{-15}$ | $9 \times 10^{-9}$ |
| Al—10Cr—20Mo—20W—5Fe—5Co—5Ni—5Cu | $4 \times 10^{-14}$ | $7 \times 10^{-10}$ |
| Al—10Cr—20Mo—20W—2Nb—3Ta—5Fe—5Co—5Ni—5Cu | $3 \times 10^{-14}$ | $6 \times 10^{-10}$ |
| Al—46Cr—2Mo—2W—2Nb—2Ta—5Fe—5Co—5Ni—5Cu | $3 \times 10^{-15}$ | $8 \times 10^{-9}$ |
| Al—43Cr—3Mo—4W—2Ti—3Zr—5Fe—5Co—5Ni—5Cu | $2 \times 10^{-15}$ | $7 \times 10^{-9}$ |
| Al—10Cr—20Mo—20W—2Ti—3Zr—5Fe—5Co—5Ni—5Cu | $4 \times 10^{-14}$ | $1 \times 10^{-10}$ |
| Al—36Cr—2Mo—2W—2Nb—2Ta—5Ti—5Zr—5Fe—5Co—5Ni—5Cu | $5 \times 10^{-15}$ | $8 \times 10^{-9}$ |
| Al—10Cr—10Mo—10W—10Nb—10Ta—2Ti—3Zr—5Fe—5Co—5Ni—5Cu | $1 \times 10^{-14}$ | $2 \times 10^{-9}$ |
| Cr—20Mo—20W—12Nb—13Ta | $7 \times 10^{-14}$ | $4 \times 10^{-10}$ |
| Cr—2Mo—2W—2Nb—3Ta—10Ti—10Zr | $1 \times 10^{-14}$ | $8 \times 10^{-9}$ |
| Cr—2Mo—2W—2Nb—3Ta—30Ti—30Zr | $4 \times 10^{-14}$ | $5 \times 10^{-9}$ |
| Cr—20Mo—20W—7Nb—7Ta—7Ti—7Zr | $7 \times 10^{-14}$ | $3 \times 10^{-10}$ |
| Cr—10Mo—10W—12Nb—13Ta—12Ti—13Zr | $5 \times 10^{-14}$ | $7 \times 10^{-10}$ |
| Cr—10Mo—10W—20Nb—20Ta—5Ti—5Zr | $6 \times 10^{-14}$ | $5 \times 10^{-10}$ |
| Cr—10Mo—10W—12Nb—13Ta—2Ti—3Zr—5Fe—5Co—5Ni—5Cu | $5 \times 10^{-14}$ | $2 \times 10^{-9}$ |
| Cr—5Mo—5W—15Nb—15Ta—5Ti—5Zr—5Fe—5Co—5Ni—5Cu | $3 \times 10^{-14}$ | $4 \times 10^{-9}$ |
| Cr—4Mo—5W—12Ti—13Zr | $2 \times 10^{-14}$ | $1 \times 10^{-9}$ |
| Cr—4Mo—5W—30Ti—30Zr | $5 \times 10^{-14}$ | $8 \times 10^{-10}$ |
| Cr—22Mo—22W—12Ti—13Zr | $9 \times 10^{-14}$ | $3 \times 10^{-10}$ |
| Cr—4Mo—5W—12Ti—13Zr—5Fe—3Co—5Ni—5Cu | $7 \times 10^{-14}$ | $9 \times 10^{-9}$ |
| Cr—12Mo—13W—12Ti—13Zr—5Fe—5Co—5Ni—5Cu | $9 \times 10^{-14}$ | $6 \times 10^{-9}$ |

EXAMPLE 8

A variety of amorphous alloys shown in Table 3 were prepared similarly to Example 7. The fact that these alloys are all in the amorphous state was confirmed by X-ray diffraction.

The corrosion tests were carried out in air at 950° C. and in sulfur vapor at $10^{-2}$ Torr at 950° C. Their parabolic rate constants for oxidation and sulfidation are extremely low as shown in Table 3.

Consequently, these amorphous alloys are highly resistant to hot corrosion in sulfidizing and oxidizing atmospheres.

TABLE 3

Parabolic rate constants of oxidation at 950° C. in air and sulfidation at 950° C. under a sulfur pressure of $10^2$ atm for amorphous alloys

| Alloy | Parabolic Rate Constant ($g^2cm^{-4}s^{-1}$) Oxidation | Sulfidation |
|---|---|---|
| Al—3Nb—4Ta | $1 \times 10^{-13}$ | $5 \times 10^{-10}$ |
| Al—35Nb—35Ta | $2 \times 10^{-12}$ | $3 \times 10^{-11}$ |
| Ai—3Nb—4Ta—2Ti—3Zr | $1 \times 10^{-13}$ | $2 \times 10^{-10}$ |
| Al—3Nb—4Ta—34Ti—34Zr | $3 \times 10^{-12}$ | $5 \times 10^{-10}$ |
| Al—30Nb—30Ta—7Ti—8Zr | $7 \times 10^{-12}$ | $5 \times 10^{-10}$ |
| Al—3Nb—4Ta—5Fe—5Co—5Ni—5Cu | $1 \times 10^{-13}$ | $7 \times 10^{-9}$ |
| Al—25Nb—30Ta—5Fe—5Co—5Ni—5Cu | $1 \times 10^{-12}$ | $1 \times 10^{-10}$ |
| Al—3Nb—4Ta—3Ti—4Zr—5Fe—5Co—5Ni—5Cu | $1 \times 10^{-13}$ | $8 \times 10^{-9}$ |
| Al—3Nb—4Ta—24Ti—24Zr—5Fe—5Co—5Ni—5Cu | $5 \times 10^{-12}$ | $3 \times 10^{-10}$ |
| Al—24Nb—24Ta—3Ti—4Zr—5Fe—5Co—5Ni—5Cu | $4 \times 10^{-12}$ | $1 \times 10^{-10}$ |
| Al—13Nb—13Ta—13Ti—13Zr—5Fe—5Co—5Ni—5Cu | $3 \times 10^{-12}$ | $2 \times 10^{-10}$ |
| Al—43Cr—3Nb—4Ta | $2 \times 10^{-13}$ | $8 \times 10^{-9}$ |
| Al—10Cr—20Nb—20Ta | $1 \times 10^{-12}$ | $5 \times 10^{-11}$ |
| Al—43Cr—3Nb—4Ta—12Ti—13Zr | $2 \times 10^{-13}$ | $6 \times 10^{-9}$ |
| Al—10Cr—20Nb—20Ta—12Ti—13Zr | $1 \times 10^{-12}$ | $8 \times 10^{-11}$ |
| Al—43Cr—3Nb—4Ta—5Fe—5Co—5Ni—5Cu | $1 \times 10^{-13}$ | $8 \times 10^{-9}$ |
| Al—10Cr—20Nb—20Ta—5Fe—5Co—5Ni—5Cu | $5 \times 10^{-12}$ | $8 \times 10^{-10}$ |
| Al—43Cr—3Nb—4Ta—2Ti—3Zr—5Fe—5Co—5Ni—5Cu | $3 \times 10^{-13}$ | $8 \times 10^{-9}$ |
| Al—10Cr—20Nb—20Ta—2Ti—3Zr—5Fe—5Co—5Ni—5Cu | $3 \times 10^{-12}$ | $5 \times 10^{-10}$ |
| Cr—25Ta | $1 \times 10^{-11}$ | $1 \times 10^{-9}$ |
| Cr—25Nb | $1 \times 10^{-11}$ | $2 \times 10^{-9}$ |
| Cr—70Ta | $3 \times 10^{-11}$ | $5 \times 10^{-10}$ |
| Cr—70Nb | $4 \times 10^{-11}$ | $3 \times 10^{-10}$ |
| Cr—13Nb—12Ta | $1 \times 10^{-11}$ | $2 \times 10^{-9}$ |

TABLE 3-continued

Parabolic rate constants of oxidation at 950° C. in air and sulfidation at 950° C. under a sulfur pressure of $10^2$ atm for amorphous alloys

| Alloy | Parabolic Rate Constant ($g^2cm^{-4}s^{-1}$) Oxidation | Sulfidation |
|---|---|---|
| Cr—35Nb—35Ta | $3 \times 10^{-11}$ | $4 \times 10^{-10}$ |
| Cr—4Nb—5Ta—8Ti—8Zr | $2 \times 10^{-11}$ | $5 \times 10^{-9}$ |
| Cr—4Nb—5Ta—30Ti—30Zr | $6 \times 10^{-11}$ | $2 \times 10^{-9}$ |
| Cr—15Nb—15Ta—20Ti—20Zr | $4 \times 10^{-11}$ | $6 \times 10^{-10}$ |
| Cr—30Nb—3Ta—5Ti—5Zr | $3 \times 10^{-11}$ | $3 \times 10^{-10}$ |
| Cr—25Nb—5Fe—5Co—5Ni—5Cu | $2 \times 10^{-11}$ | $5 \times 10^{-9}$ |
| Cr—50Nb—5Fe—5Co—5Ni—5Cu | $5 \times 10^{-11}$ | $1 \times 10^{-9}$ |
| Cr—13Nb—12Ta—5Fe—5Co—5Ni—5Cu | $2 \times 10^{-11}$ | $6 \times 10^{-9}$ |
| Cr—25Nb—25Ta—5Fe—5Co—5Ni—5Cu | $6 \times 10^{-11}$ | $2 \times 10^{-9}$ |
| Cr—4Nb—5Ta—8Ti—8Zr—5Fe—5Co—5Ni—5Cu | $5 \times 10^{-11}$ | $9 \times 10^{-9}$ |
| Cr—20Nb—20Ta—5Ti—5Zr—5Fe—5Co—5Ni—5Cu | $6 \times 10^{-11}$ | $3 \times 10^{-9}$ |

EXAMPLE 9

A variety of amorphous alloys shown in Table 4 were prepared similarly to Example 7. The fact that these alloys are all in the amorphous state was confirmed by X-ray diffraction.

The corrosion tests were carried out in air at 900° C. and in sulfur vapor at $10^{-2}$ Torr at 900° C. Their parabolic rate constants for oxidation and sulfidation are extremely low as shown in Table 4.

Consequently these amorphous alloys are highly resistant to hot corrosion in sulfidizing and oxidizing atmospheres.

TABLE 4

Parabolic rate constants of oxidation at 900° C. in air and sulfidation at 900° C. under a sulfur pressure of $10^{-2}$ atm for amorphous alloys

| Alloy | Parabolic Rate Constant ($g^2cm^{-4}s^{-1}$) Oxidation | Sulfidation |
|---|---|---|
| Al—50Si—3Mo—4W | $1 \times 10^{-14}$ | $4 \times 10^{-11}$ |
| Al—40Si—25Mo—25W | $8 \times 10^{-14}$ | $2 \times 10^{-12}$ |
| Al—30Si—43Cr—3Mo—4W | $1 \times 10^{-14}$ | $9 \times 10^{-10}$ |
| Al—30Si—10Cr—20Mo—20W | $4 \times 10^{-14}$ | $2 \times 10^{-12}$ |
| Al—50Si—3Mo—4W—5Fe—5Co—5Ni—5Cu | $2 \times 10^{-14}$ | $8 \times 10^{-10}$ |
| Al—30Si—25Mo—25W—5Fe—5Co—5Ni—5Cu | $9 \times 10^{-14}$ | $4 \times 10^{-11}$ |
| Al—15Si—43Cr—3Mo—4W—5Fe—5Co—5Ni—5Cu | $2 \times 10^{-14}$ | $9 \times 10^{-10}$ |
| Al—15Si—10Cr—20Mo—20W—5Fe—5Co—5Ni—5Cu | $9 \times 10^{-14}$ | $8 \times 10^{-11}$ |
| Al—50Si—3Nb—4Ta | $3 \times 10^{-12}$ | $3 \times 10^{-11}$ |
| Al—20Si—35Nb—35Ta | $8 \times 10^{-11}$ | $2 \times 10^{-12}$ |
| Cr—50Si—13Nb—12Ta | $1 \times 10^{-12}$ | $3 \times 10^{-9}$ |
| Al—20Cr—20Si—20Nb—20Ta | $3 \times 10^{-12}$ | $5 \times 10^{-10}$ |
| Al—50Si—2Mo—1W—2Nb—2Ta | $1 \times 10^{-14}$ | $5 \times 10^{-11}$ |
| Al—10Si—25Mo—25W—12Nb—13Ta | $2 \times 10^{-12}$ | $9 \times 10^{-13}$ |
| Cr—20Si—20Mo—20W—12Nb—13Ta | $7 \times 10^{-12}$ | $4 \times 10^{-10}$ |
| Al—10Cr—20Si—20Mo—20W—12Nb—13Ta | $2 \times 10^{-12}$ | $1 \times 10^{-10}$ |
| Al—50Si—3Mo—4W—2Ti—3Zr | $1 \times 10^{-14}$ | $4 \times 10^{-11}$ |
| Al—10Si—3Mo—4W—34Ti—34Zr | $9 \times 10^{-13}$ | $7 \times 10^{-11}$ |
| Al—10Si—25Mo—25W—12Ti—13Zr | $3 \times 10^{-13}$ | $8 \times 10^{-13}$ |
| Cr—30Si—4Mo—5W—12Ti—13Zr | $2 \times 10^{-12}$ | $1 \times 10^{-9}$ |
| Cr—15Si—4Mo—5W—30Ti—30Zr | $5 \times 10^{-12}$ | $8 \times 10^{-10}$ |
| Al—10Cr—5Si—22Mo—22W—12Ti—13Zr | $9 \times 10^{-13}$ | $3 \times 10^{-10}$ |
| Al—30Si—3Nb—4Ta—2Ti—3Zr | $5 \times 10^{-12}$ | $1 \times 10^{-11}$ |
| Al—15Si—3Nb—4Ta—34Ti—34Zr | $6 \times 10^{-11}$ | $3 \times 10^{-11}$ |
| Al—15Si—30Nb—30Ta—7Ti—8Zr | $9 \times 10^{-11}$ | $3 \times 10^{-11}$ |
| Cr—50Si—4Nb—5Ta—8Ti—8Zr | $2 \times 10^{-13}$ | $6 \times 10^{-9}$ |
| Cr—15Si—4Nb—5Ta—30Ti—30Zr | $6 \times 10^{-11}$ | $3 \times 10^{-9}$ |
| Al—10Cr—20Si—15Nb—15Ta—10Ti—10Zr | $4 \times 10^{-12}$ | $7 \times 10^{-10}$ |
| Al—30Si—2Mo—1W—2Nb—2Ta—2Ti—3Zr | $1 \times 10^{-14}$ | $5 \times 10^{-11}$ |
| Al—15Si—22Mo—23W—12Nb—13Ta—2Ti—3Zr | $7 \times 10^{-13}$ | $8 \times 10^{-13}$ |
| Cr—20Si—10Mo—10W—12Nb—13Ta—12Ti—13Zr | $5 \times 10^{-12}$ | $7 \times 10^{-10}$ |
| Al—10Cr—10Si—10Mo—10W—12Nb—13Ta—12Ti—13Zr | $5 \times 10^{-13}$ | $7 \times 10^{-11}$ |
| Al—15Si—3Nb—4Ta—5Fe—5Co—5Ni—5Cu | $5 \times 10^{-12}$ | $5 \times 10^{-10}$ |
| Al—15Si—25Nb—30Ta—5Fe—5Co—5Ni—5Cu | $1 \times 10^{-10}$ | $1 \times 10^{-11}$ |
| Cr—45Si—13Nb—12Ta—5Fe—5Co—5Ni—5Cu | $2 \times 10^{-12}$ | $7 \times 10^{-9}$ |
| Al—10Cr—20Si—20Nb—20Ta—5Fe—5Co—5Ni—5Cu | $6 \times 10^{-11}$ | $1 \times 10^{-9}$ |
| Al—15Si—25Mo—25W—2Nb—2Ta—5Fe—5Co—5Ni—5Cu | $9 \times 10^{-14}$ | $2 \times 10^{-11}$ |
| Cr—15Si—2Mo—2W—25Nb—25Ta—5Fe—5Co—5Ni—5Cu | $3 \times 10^{-11}$ | $4 \times 10^{-10}$ |
| Al—5Cr—15Si—13Mo—13W—13Nb—13Ta—5Fe—5Co—5Ni—5Cu | $5 \times 10^{-12}$ | $8 \times 10^{-11}$ |
| Al—15Si—25Mo—25W—2Ti—2Zr—5Fe—5Co—5Ni—5Cu | $8 \times 10^{-14}$ | $2 \times 10^{-11}$ |
| Cr—15Si—2Mo—2W—25Ti—25Zr—5Fe—5Co—5Ni—5Cu | $2 \times 10^{-12}$ | $2 \times 10^{-9}$ |
| Al—5Cr—15Si—13Mo—13W—13Ti—13Zr—5Fe—5Co—5Ni—5Cu | $1 \times 10^{-12}$ | $9 \times 10^{-11}$ |
| Al—15Si—3Nb—4Ta—3Ti—4Zr—5Fe—5Co—5Ni—5Cu | $8 \times 10^{-12}$ | $5 \times 10^{-10}$ |
| Al—15Si—3Nb—4Ta—24Ti—24Zr—5Fe—5Co—5Ni—5Cu | $4 \times 10^{-11}$ | $2 \times 10^{-11}$ |
| Al—15Si—24Nb—24Ta—3Ti—4Zr—5Fe—5Co—5Ni—5Cu | $7 \times 10^{-11}$ | $1 \times 10^{-11}$ |

TABLE 4-continued

Parabolic rate constants of oxidation at 900° C. in air and sulfidation at 900° C. under a sulfur pressure of $10^{-2}$ atm for amorphous alloys

| Alloy | Parabolic Rate Constant ($g^2cm^{-4}s^{-1}$) Oxidation | Sulfidation |
|---|---|---|
| Al—15Si—13Nb—13Ta—13Ti—13Zr—5Fe—5Co—5Ni—5Cu | $6 \times 10^{-11}$ | $2 \times 10^{-11}$ |
| Cr—45Si—4Nb—5Ta—8Ti—8Zr—5Fe—5Co—5Ni—5Cu | $5 \times 10^{-12}$ | $9 \times 10^{-9}$ |
| Cr—20Si—20Nb—20Ta—5Ti—5Zr—5Fe—5Co—5Ni—5Cu | $6 \times 10^{-12}$ | $4 \times 10^{-9}$ |
| Al—43Cr—15Si—3Nb—4Ta—2Ti—3Zr—5Fe—5Co—5Ni—5Cu | $3 \times 10^{-12}$ | $6 \times 10^{-10}$ |
| Al—10Cr—15Si—20Nb—20Ta—2Ti—3Zr—5Fe—5Co—5Ni—5Cu | $5 \times 10^{-11}$ | $3 \times 10^{-11}$ |
| Al—15Si—3Mo—4W—3Nb—4Ta—20Ti—20Zr—5Fe—5Co—5Ni—5Cu | $4 \times 10^{-13}$ | $7 \times 10^{-11}$ |
| Al—15Si—3Mo—4W—20Nb—20Ta—4Ti—4Zr—5Fe—5Co—5Ni—5Cu | $5 \times 10^{-11}$ | $3 \times 10^{-11}$ |
| Cr—20Si—10Mo—10W—12Nb—13Ta—2Ti—3Zr—5Fe—5Co—5Ni—5Cu | $5 \times 10^{-14}$ | $2 \times 10^{-9}$ |
| Al—5Cr—15Si—20Mo—20W—3Nb—4Ta—4Ti—4Zr—5Fe—5Co—5Ni—5Cu | $6 \times 10^{-12}$ | $2 \times 10^{-11}$ |
| Al—36Cr—15Si—2Mo—2W—2Nb—2Ta—5Ti—5Zr—5Fe—5Co—5Ni—5Cu | $5 \times 10^{-14}$ | $9 \times 10^{-10}$ |
| Al—10Cr—15Si—10Mo—10W—10Nb—10Ta—2Ti—3Zr—5Fe—5Co—5Ni—5Cu | $1 \times 10^{-13}$ | $4 \times 10^{-10}$ |
| Al—15Si—46Cr—2Mo—2W—2Nb—2Ta—10Ti—10Zr | $6 \times 10^{-14}$ | $7 \times 10^{-10}$ |
| Al—15Si—10Cr—20Mo—20W—10Nb—10Ta—2Ti—3Zr | $9 \times 10^{-13}$ | $7 \times 10^{-12}$ |
| Al—15Si—10Cr—20Mo—20W—2Nb—3Ta—5Fe—5Co—5Ni—5Cu | $8 \times 10^{-14}$ | $7 \times 10^{-11}$ |
| Al—15Si—46Cr—2Mo—2W—2Nb—2Ta—5Fe—5Co—5Ni—5Cu | $3 \times 10^{-14}$ | $9 \times 10^{-10}$ |
| Al—15Si—43Cr—3Mo—4W—2Ti—3Zr—5Fe—5Co—5Ni—5Cu | $3 \times 10^{-14}$ | $9 \times 10^{-10}$ |
| Al—15Si—10Cr—20Mo—20W—2Ti—3Zr—5Fe—5Co—5Ni—5Cu | $7 \times 10^{-14}$ | $3 \times 10^{-11}$ |
| Al—15Si—43Cr—3Nb—4Ta | $1 \times 10^{-12}$ | $6 \times 10^{-10}$ |
| Al—15Si—10Cr—20Nb—20Ta | $4 \times 10^{-11}$ | $3 \times 10^{-12}$ |
| Al—15Si—43Cr—3Nb—4Ta—12Ti—13Zr | $7 \times 10^{-12}$ | $4 \times 10^{-10}$ |
| Al—15Si—10Cr—20Nb—20Ta—12Ti—13Zr | $7 \times 10^{-11}$ | $6 \times 10^{-12}$ |
| Al—15Si—43Cr—3Nb—4Ta—5Fe—5Co—5Ni—5Cu | $8 \times 10^{-12}$ | $6 \times 10^{-10}$ |
| Al—15Si—10Cr—20Nb—20Ta—5Fe—5Co—5Ni—5Cu | $4 \times 10^{-11}$ | $6 \times 10^{-11}$ |

What is claimed is:

1. An amorphous alloy resistant against hot corrosion, which consists of 25–70 atomic percent of at least one element selected from the group of Ta and Nb, with the balance being substantially Cr.

2. An amorphous alloy resistant against hot corrosion, which consists of 25–70 atomic percent of the sum of (1) at least one element selected from the group of Ti and Zr and (2) at least 9 atomic percent of at least one element selected from the group of Ta and Nb, with the balance being substantially Cr, and at least one of Ti and Zr being present in the alloy.

3. An amorphous alloy resistant against hot corrosion, which consists of at most 20 atomic percent of at least one element selected from the group of Fe, Co, Ni and Cu and at least 25 atomic percent and less than 70 atomic percent of at least one element selected from Ta and Nb, with the balance being substantially at least 30 atomic percent of Cr.

4. An amorphous alloy resistant against hot corrosion, which consists of at most 20 atomic percent of at least one element selected from the group of Fe, Co, Ni and Cu and at least 25 atomic percent and less than 70 atomic percent of the sum of (1) at least one element selected from the group of Ti and Zr and (2) at least 9 atomic percent of at least one element selected from the group of Ta and Nb, with the balance being substantially at least 30 atomic percent of Cr, and at least one of Ti and Zr being present in the alloy.

* * * * *

UNITED STATES PATENT AND TRADEMARK OFFICE

CERTIFICATE OF CORRECTION

PATENT NO. : 5 380 375

DATED : January 10, 1995

INVENTOR(S) : Koji HASHIMOTO et al

It is certified that error appears in the above-indentified patent and that said Letters Patent is hereby corrected as shown below:

In the title page, item [75], please change "Cracow" to ---Krakow---.

Signed and Sealed this

Fourteenth Day of March, 1995

Bruce Lehman

*Attest:*

BRUCE LEHMAN

*Attesting Officer*

*Commissioner of Patents and Trademarks*